US012631085B2

(12) United States Patent
Glaesman et al.

(10) Patent No.: US 12,631,085 B2
(45) Date of Patent: May 19, 2026

(54) MAGNETICALLY GRADED ADAPTOR FOR A WELLBORE SEALING SYSTEM

(71) Applicants: Halliburton Energy Services, Inc., Houston, TX (US); The University of Texas System Board of Regents, El Paso, TX (US)

(72) Inventors: Chad W. Glaesman, Singapore (SG); Joshua Taylor Green, El Paso, TX (US); Sandeep Thatathil, Singapore (SG)

(73) Assignee: Halliburton Energy Services, Inc. and The University of Texas System Board of Regents, TX (US)

( * ) Notice: Subject to any disclaimer, the term of this patent is extended or adjusted under 35 U.S.C. 154(b) by 0 days.

(21) Appl. No.: 18/934,699

(22) Filed: Nov. 1, 2024

(65) Prior Publication Data

US 2026/0125963 A1 May 7, 2026

(51) Int. Cl.
*E21B 33/12* (2006.01)

(52) U.S. Cl.
CPC ..... *E21B 33/1216* (2013.01)

(58) Field of Classification Search
CPC ..... E21B 33/1216; E21B 33/12; E21B 33/02; E21B 33/00; E21B 33/128; F16J 15/3444
See application file for complete search history.

(56) References Cited

U.S. PATENT DOCUMENTS

| | | | | |
|---|---|---|---|---|
| 4,406,469 | A | 9/1983 | Allison | |
| 5,161,804 | A * | 11/1992 | Orlowski | F16J 15/3444 277/378 |
| 5,309,993 | A | 5/1994 | Coon et al. | |
| 6,220,602 | B1 * | 4/2001 | Webster | F16J 15/3288 277/378 |
| 12,345,253 | B2 * | 7/2025 | Mullins | F04B 53/164 |
| 12,352,126 | B2 * | 7/2025 | Miller | E21B 33/10 |
| 12,404,931 | B2 * | 9/2025 | Ellisor | F16J 15/26 |
| 2016/0298768 | A1 * | 10/2016 | De Lapersonne | F16J 15/3444 |
| 2018/0045006 | A1 | 2/2018 | Prieto et al. | |
| 2022/0003067 | A1 | 1/2022 | Glaesman | |
| 2022/0381104 | A1 * | 12/2022 | Eldho | E21B 33/1216 |
| 2024/0309724 | A1 | 9/2024 | Miller et al. | |

FOREIGN PATENT DOCUMENTS

| | | | |
|---|---|---|---|
| JP | 09049573 | A * | 2/1996 |
| WO | 2019226959 | A1 | 11/2019 |

OTHER PUBLICATIONS

Application No. PCT/US2024/058635, International Search Report and Written Opinion, Mailed on Jul. 26, 2025, 11 pages.

* cited by examiner

*Primary Examiner* — Eugene G Byrd
(74) *Attorney, Agent, or Firm* — Kilpatrick Townsend & Stockton, LLP

(57) ABSTRACT

An adaptor can be used with respect to a wellbore sealing system. The adaptor can include a first adaptor component that includes a magnet. The first adaptor component can be coupled with the wellbore sealing system. The adaptor can include a second adaptor component that includes a filler material that is magnetically graded. The second adaptor component can be coupled to the wellbore sealing system and can be positioned with respect to the first adaptor component to cause the magnet and the filler material to magnetically interact for applying a sealing force to the wellbore sealing system.

14 Claims, 8 Drawing Sheets

MAGNETICALLY GRADED ADAPTOR FOR A WELLBORE SEALING SYSTEM

TECHNICAL FIELD

The present disclosure relates generally to wellbore operations and, more particularly (although not necessarily exclusively), to a magnetically graded adaptor for a wellbore sealing system.

BACKGROUND

A wellbore can be a hole that can be drilled into a subterranean formation for extracting produced material such as hydrocarbon material, water, and the like. A well tool can be deployed downhole in a wellbore. The well tool can include a sealing system for preventing fluids from entering an interior of the well tool. The sealing system can include a sealing material, such as a polymeric sealing material. The volume and performance of the polymeric sealing material can depend on the temperature and the pressure of the polymeric sealing material.

DETAILED DESCRIPTION

Figure 1:
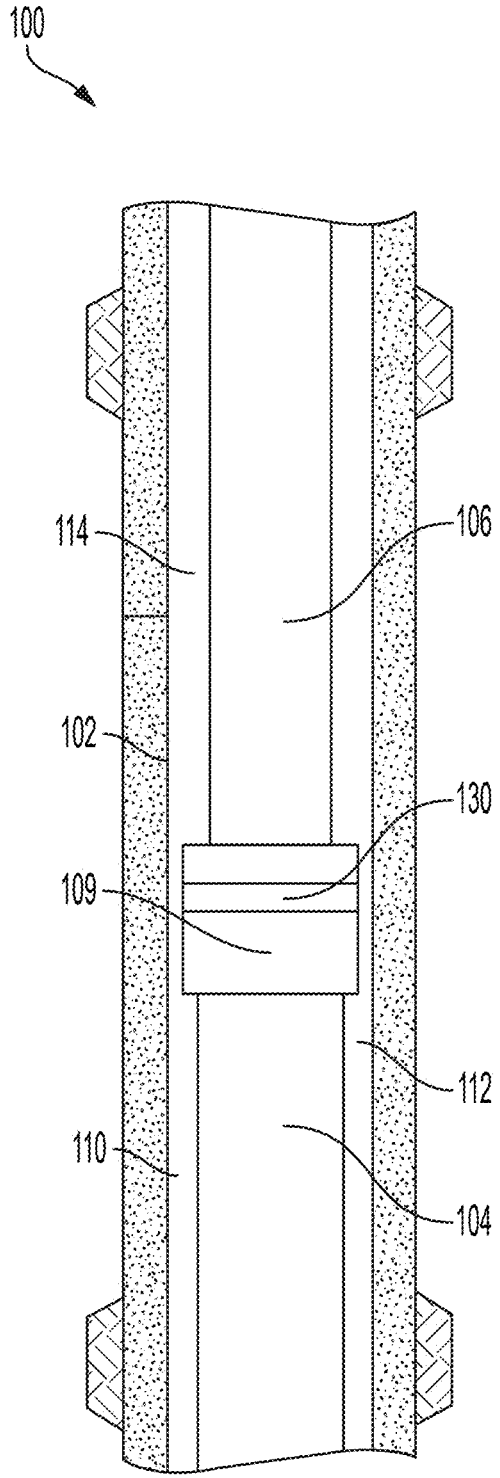
FIG. 1 is a sectional side view of a wellbore that can include a magnetically graded adaptor for a wellbore sealing system according to one example of the present disclosure.

Certain aspects and features of the present disclosure relate to a magnetically graded adaptor for a wellbore sealing system. A wellbore sealing system can be deployed in a wellbore, and the wellbore sealing system can include sealing materials. For example, the wellbore sealing system can include polymeric sealing materials, metallic sealing materials, and the like. The wellbore sealing system can include one or more seals that can isolate a region, for example with respect to a wellbore tool, from the wellbore environment. The magnetically graded adaptor can include a magnet, a filler material that is magnetically graded, or the like for facilitating magnetic-based sealing forces in the wellbore sealing system. For example, the adaptor can be magnetically graded such that the filler material within the adaptor includes a magnetic gradient and is dispersed according to a concentration profile for applying a magnetic force on a corresponding adaptor to apply adequate pressure on the wellbore sealing system even in low-temperature (e.g., less than 0° C. or 32° F.) environments. The concentration profile can involve an increasing (or decreasing) concentration of magnetic particles in one direction. For example, a concentration of magnetic particles of the filler material can increase from a first location of the filler material to a second location of the filler material. Accordingly, a magnetic gradient can exist in the filler material such that the magnetic force applied or experienced by the filler material increases (or decreases) in a particular direction (e.g., magnetically graded). The filler material can include particles (e.g., less than 50 microns) of magnetic material such as iron or other suitable magnetic or ferromagnetic material.

Sealing materials can experience volumetric losses and diminished elasticity under conditions of low temperature and high pressure due to the degrading effects of thermal expansion and bulk modulus. Loss of volume and elasticity can result in a diminished sealing performance. Incorporating magnetic material into sealing systems can reduce loss in performance that sealing systems can experience during thermal and pressure cycles and additionally over time due to creep and other viscous responses.

A wellbore sealing system can use magnets, magnetically filled polymeric materials, or the like that incorporate magnetic concentration gradients to create components of sealing systems with customizable load profiles. Customizable load profiles can be used to maintain or manipulate contact stresses on the wellbore sealing systems. The gradient profiles can be created though additive manufacturing techniques. The additive manufacturing techniques can involve a mixing print head that can allow for dynamic adjustment of feedstock concentrations in three dimensions throughout the profile to create the gradients. Additionally, techniques to create customizable load profiles over broad ranges of travel to compensate for losses in sealing performance due to creep and changes in environmental conditions can be used.

Dispersed filler material can be used in polymeric binders at various concentrations to influence the load profile of wellbore sealing system components. The dispersed filler material can enable customizing of the load profiles of sealing systems across broad range of deflections or deformations to compensate for any long term dimensional or volumetric changes that sealing components may experience. Maintaining a load on the wellbore sealing system can improve performance (e.g., compared to wellbore sealing systems without a magnetically graded adaptor) of the wellbore sealing system by maintaining contact stresses between the primary seal component and the mating sealing surfaces.

In some examples, the wellbore sealing system can include a set of adaptor components that can couple with each other as well as with the wellbore sealing system. In one such example, a first adaptor component can include a magnet and can be coupled to the wellbore sealing system. Additionally, a second adaptor component can include a filler material that is magnetically graded that can interact magnetically with the magnet. For example, the filler material can interact magnetically with the magnet for causing a repulsive force between the first adaptor component and the second adaptor component. The second adaptor component can be coupled with the sealing system and the first adaptor component. The repulsive force between the first adaptor component and the second adaptor component can cause the first adaptor component to exert a force on the wellbore sealing system. Similarly, the repulsive force can cause the second adaptor component to exert a force on the wellbore sealing system. Exerting forces on the wellbore sealing system can result in an improved sealing pressure (e.g., compared to sealing systems without the first adaptor component and the second adaptor component) of the wellbore sealing system at one or more sealing interfaces and at low temperatures.

In some examples, the wellbore sealing system can include a set of adaptor components that can couple with each other. The adaptor components can couple with the wellbore sealing system. Each adaptor component can include its own magnet. For example, a first adaptor component can include a first magnet, and a second adaptor component can include a second magnet. Each adaptor component can also include its own filler material that is magnetically graded. For example, the first adaptor component can include a first filler material that is magnetically graded, and the second adaptor component can include a second filler material that is magnetically graded. In some examples, the first filler material, the second filler material, or a combination thereof can include a set of magnetic or ferromagnetic particles. The first magnet can interact magnetically with the second filler material to generate a first repulsive force among the first adaptor component and the second adaptor component. The second magnet can interact magnetically with the first filler material to generate a second repulsive force. The first repulsive force and the second repulsive force can cause the first adaptor component and the second adaptor component to exert forces on the wellbore sealing system. Exerting forces on the wellbore sealing system can improve a sealing pressure at one or more sealing interfaces of the wellbore sealing system.

In some examples, the wellbore sealing system can include a first adaptor component and a second adaptor component, and each adaptor component can include a filler material that is magnetically graded and multiple magnets that can be positioned on opposite ends of the respective adaptor component. The first adaptor component can include a first inner magnet and a first outer magnet. The first inner magnet and the first outer magnet can be positioned in opposite ends of the first adaptor. The second adaptor component can include a second inner magnet and a second outer magnet. The second inner magnet and the second outer magnet may be positioned in opposite ends of the second adaptor component. The first adaptor component can apply a force to a wellbore sealing system, and the second adaptor component can apply a force to the wellbore sealing system. By applying forces to the seal portions, the adaptor components can increase a sealing pressure at one or more sealing interfaces of the wellbore sealing system.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a sectional side view of a well system 100 that can include a magnetically graded adaptor for a wellbore sealing system according to one example of the present disclosure. As illustrated, the well system 100 includes a wellbore 102. In some examples, the wellbore 102 can be cased and cemented, as illustrated in FIG. 1. In some examples, the wellbore 102 can be uncased or the casing may not be cemented.

The wellbore 102 can include a tubular string 104, for example, a downhole completion string or any other suitable tubular string. The tubular string 104 can be positioned in a downhole portion 112 of the wellbore 102. An annulus 110 can be formed between the tubular string 104 and the wellbore 102. The wellbore 102 can further include a tubular string 106, for example, an uphole completion string or any other suitable tubular string. The tubular string 106 can be positioned in an uphole portion 114 of the wellbore 102 with respect to the downhole tool 109. In some examples, the downhole tool 109 can include a wet-mate connector assembly. The downhole tool 109 may provide an electrical connection between an electric line associated with the tubular string 106 and a hydraulic line associated with the tubular string 104, respectively. In doing so, the downhole tool 109 may form an electrical connection between equipment that can be positioned on the surface and another tool that can be positioned downhole in the wellbore 102, such as a sensor component.

The downhole tool 109 can include materials or components that can be degraded or damaged by brine, drilling mud, water, formation fluids, or other wellbore fluids that may be present in the wellbore 102. For example, the downhole tool 109 can include electronic components that can experience short-circuiting or corrosion due to contact with wellbore fluids. The downhole tool 109 can include a wellbore sealing system 130 for creating a seal between an interior portion of the downhole tool 109 and the wellbore 102, thereby preventing an ingress of wellbore fluids into the interior portion of the downhole tool 109. In some examples, the wellbore sealing system 130 can include a magnetically graded adaptor for improving (e.g., with respect to other sealing systems without a magnetically graded adaptor) a low-temperature functionality of the wellbore sealing system 130.

Figure 2:
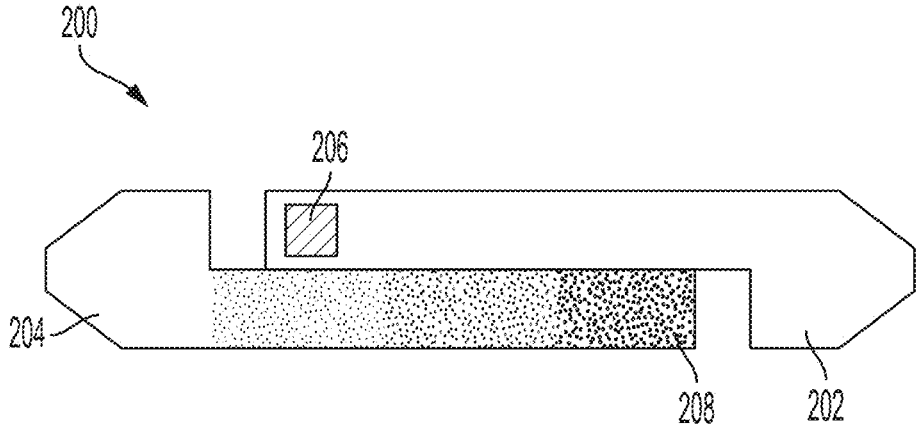
FIG. 2 is a schematic of a magnetically graded adaptor for a wellbore sealing system according to one example of the present disclosure.

FIG. 2 is a schematic of a magnetically graded adaptor 200 for a wellbore sealing system 130 according to one example of the present disclosure. The magnetically graded adaptor 200 can include a first adaptor component 202, a second adaptor component 204, and any other suitable components. The first adaptor component 202 can include a magnet 206. The magnet 206 can be positioned on or within the first adaptor component 202. For example, the first adaptor component 202 can include a cavity that can house the magnet 206. The second adaptor component 204 can include a filler material 208 that is magnetically graded. The filler material 208 can be dispersed in a gradient, such that the density of filler material 208 is not constant throughout the second adaptor component 204. For example, the density of the filler material 208 in the second adaptor component 204 can increase in one direction, decrease in a second direction, etc., and, by extension, the magnetic field or magnetic force emitted or experienced by the second adaptor component 204 can increase in one direction, decrease in a second direction, etc.

In some examples, the density of the filler material 208 can increase along an axis of the second adaptor component 204. For example, the density of the filler material 208 can be at a highest value at a first end of the second adaptor component 204, and the density of the filler material 208 can be at a lowest value at a second end of the second adaptor component 204. The magnet 206 and the filler material 208 can generate a repulsive force among the first adaptor component 202 and the second adaptor component 204. For example, the magnet 206 and the filler material 208 can interact magnetically to generate the repulsive force. In some examples, the magnetic interaction can include one or more magnetic dipole-dipole interactions, where magnetic dipoles in the magnet 206 generate the repulsive force with respect to magnetic dipoles in the filler material 208.

The first adaptor component 202 and the second adaptor component 204 can be positioned such that the repulsive force among the first adaptor component 202 and the second adaptor component 204 causes the first adaptor component 202 and the second adaptor component 204 to apply a force to parts of the wellbore sealing system 130. For example, the first adaptor component 202 and the second adaptor component 204 can apply a force to the wellbore sealing system 130 that can improve the sealing pressure of the wellbore sealing system 130 in various scenarios such as a low-temperature environment, a high-pressure environment, etc. The gradient of the filler material 208 can be determined according to a concentration profile that can be fine-tuned to match a load profile for the wellbore sealing system 130. The load profile can determine how the force applied to the sealing system changes as a function of the deflection of the wellbore sealing system.

Figure 3:
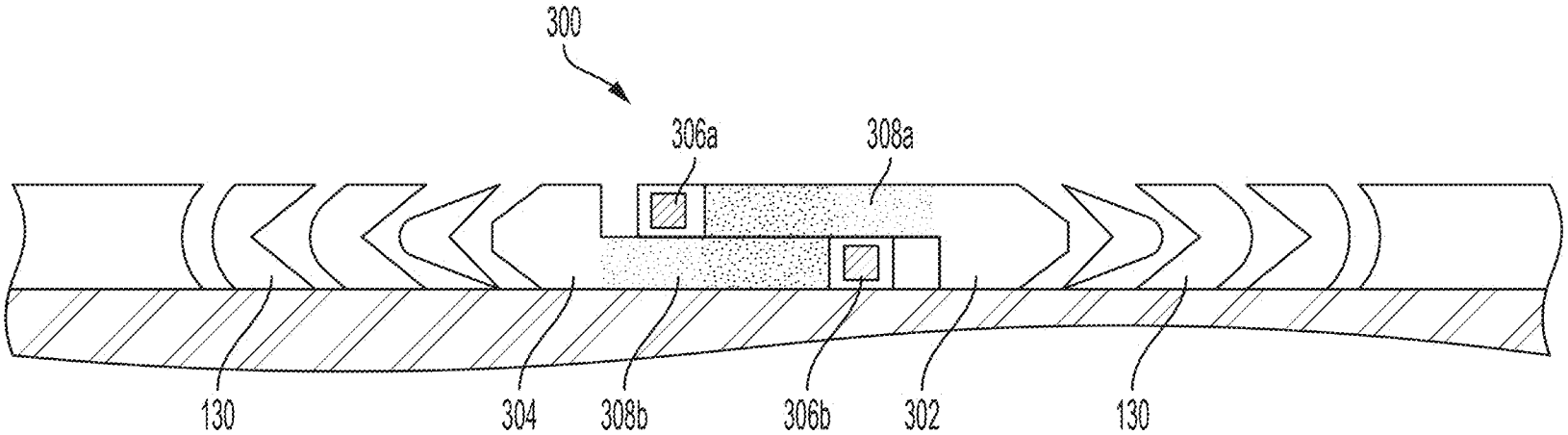
FIG. 3 is a schematic of a magnetically graded adaptor for a wellbore sealing system with two magnets and two filler materials according to one example of the present disclosure.

FIG. 3 is a schematic of a magnetically graded adaptor 300 for a wellbore sealing system according to one example of the present disclosure. The magnetically graded adaptor 300 can include a first adaptor component 302 and a second adaptor component 304. The first adaptor component 302 can include a first magnet 306*a* and a first filler material 308*a* that is magnetically graded. The second adaptor component 304 can include a second magnet 306*b* and a second filler material 308*b* that is magnetically graded. In some examples, the first filler material 308*a* and the second filler material 308*b* can be magnetically graded in opposite directions. The first filler material 308*a* can include material that may be similar or identical to material included in the second filler material 308*b*. In some examples, the first filler material 308*a* and the second filler material 308*b* can be include particles of magnetic or ferromagnetic metal. For example, the particles of magnetic or ferromagnetic metal can include microparticles or nanoparticles. The first magnet 306*a* can be similar or identical to the second magnet 306*b*, and the first magnet 306*a* can include a similar or identical magnetic strength compared to that of the second magnet 306*b*.

The first magnet 306*a* and the second filler material 308*b* can generate equal (or substantially equal) and opposite repulsive forces with respect to one another. For example, the first magnet 306*a* can interact magnetically with the second filler material 308*b* to generate the repulsive force. Similarly, the second magnet 306*b* and the first filler material 308*a* can generate approximately equal and opposite repulsive forces with respect to one another. The second magnet 306*b* can interact magnetically with the first filler material 308*a* to generate the repulsive force. Accordingly, the first adaptor component 302 can use the repulsive force to apply a first subsequent force to the wellbore sealing system 130, and the second adaptor component 304 can use the repulsive force to apply a second subsequent force to the wellbore sealing system 130.

Figure 4:
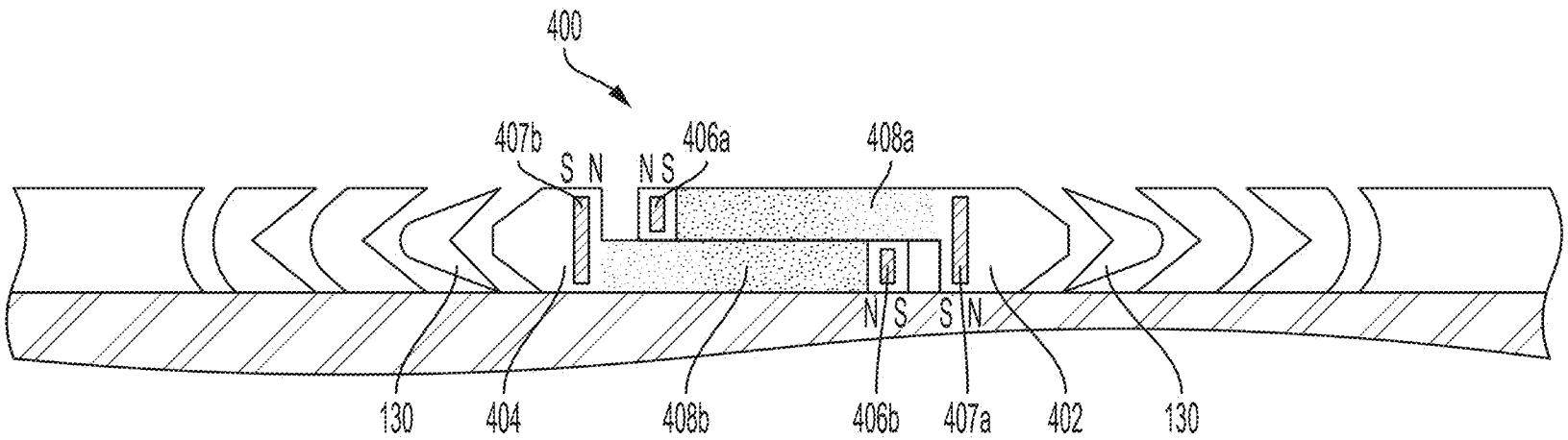
FIG. 4 is a schematic of a magnetically graded adaptor for a wellbore sealing system according to one example of the present disclosure.

FIG. 4 is a schematic of a magnetically graded adaptor 400 for a wellbore sealing system 130 according to one example of the present disclosure. The magnetically graded adaptor 400 can include a first adaptor component 402 and a second adaptor component 404. The first adaptor component 402 can include a first inner magnet 406*a* and a first outer magnet 407*a*, and the first inner magnet 406*a* and the first outer magnet 407*a* can be positioned in opposite ends of the first adaptor component 402. The second adaptor component 404 can include a second inner magnet 406*b* and a second outer magnet 407*b*. The second inner magnet 406*b* and the second outer magnet 407*b* may be positioned in opposite ends of the second adaptor component 404.

The first inner magnet 406*a* and the second filler material 408*b*, which can be magnetically graded, can generate equal (or substantially equal) and opposite repulsive forces with respect to one another. For example, the first inner magnet 406*a* can interact magnetically with the second filler material 408*b* to generate the repulsive force. Similarly, the second inner magnet 406*b* and the first filler material 408*a*, which can be magnetically graded, can generate approximately equal and opposite repulsive forces with respect to one another. The second inner magnet 406*b* can interact magnetically with the first filler material 408*a* to generate the repulsive force. Additionally, the first outer magnet 407*a* can magnetically interact with the second inner magnet 406*b* to generate a repulsive force, and the second outer magnet 407*b* can magnetically interact with the first inner magnet 406*a* to generate a repulsive force. Accordingly, the first adaptor component 402 can use the various repulsive forces, generated by the magnets and filler material, to apply a first sealing force to the wellbore sealing system 130. Additionally or alternatively, the second adaptor component 404 can use the various repulsive forces, generated by the magnets and filler material, to apply a second sealing force to the wellbore sealing system 130. By applying the sealing forces to the wellbore sealing system 130 the first adaptor component 402 and the second adaptor component 404 can increase a sealing pressure of the sealing system and compensate for a deflection of the wellbore sealing system 130.

Figure 5:
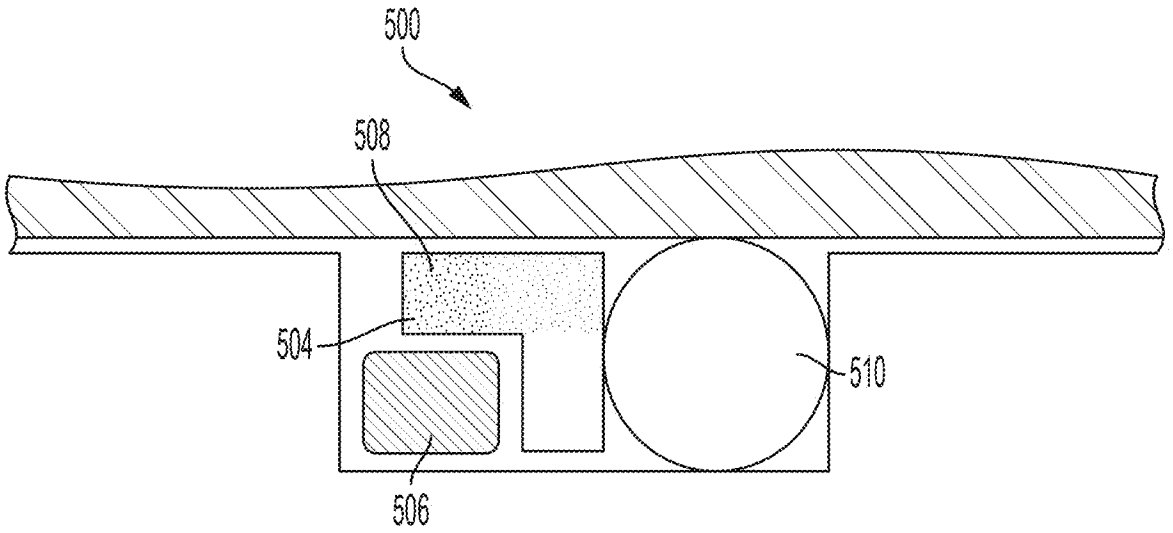
FIG. 5 is a schematic of a magnetically graded adaptor for an O-ring sealing system according to one example of the present disclosure.

FIG. 5 is a schematic of a magnetically graded adaptor for an O-ring sealing system 500 according to one example of the present disclosure. The O-ring sealing system 500 can include an O-ring 510. The magnetically graded adaptor component 504 can include a magnet 506 and an adaptor component 504 that can abut the O-ring 510. The adaptor component 504 can include a filler material 508 that is magnetically graded. The filler material 508 can be dispersed in a gradient throughout a portion of the adaptor component 504. The magnet 506 and the filler material 508 can exert repulsive forces on each other. The repulsive force exerted on the adaptor component 504 can cause the adaptor component 504 to exert a force on the O-ring 510. For example, as the magnet 506 gets closer to a denser portion of the filler material 508, the repulsive force may increase, which may cause the force exerted on the O-ring 510 to increase. The force exerted on the O-ring 510 can increase a sealing pressure associated with the O-ring 510.

Figure 6:
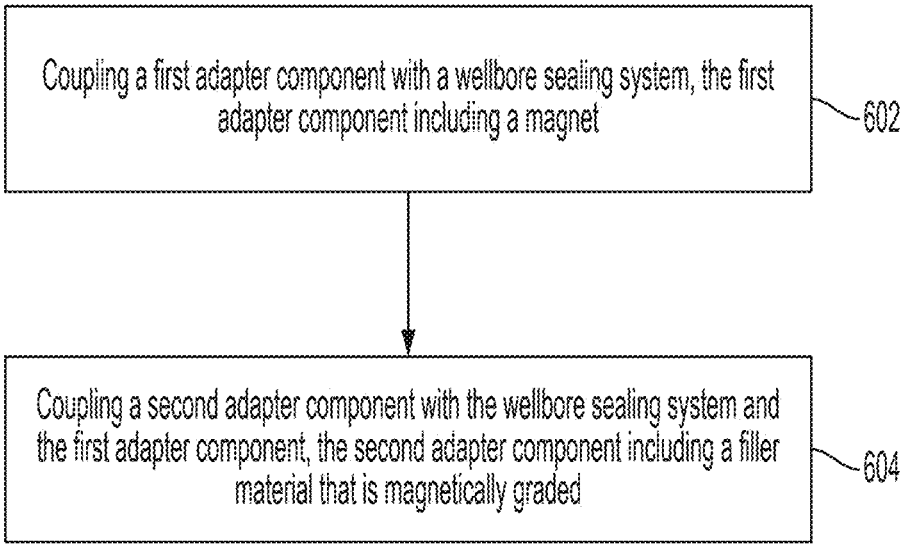
FIG. 6 is a flowchart of a process for using a magnetically graded adaptor for a wellbore sealing system according to one example of the present disclosure.

FIG. 6 is a flowchart of a process 600 for using a magnetically graded adaptor 200 for a wellbore sealing system 130 according to one example of the present disclosure. At block 602, a first adaptor component 302 is coupled with the wellbore sealing system 130 of the wellbore sealing system 130. The first adaptor component 302 can include a magnet 306. Coupling the first adaptor component 302 with the wellbore sealing system 130 can involve mechanically engaging or otherwise suitably connecting the first adaptor component 302 with the wellbore sealing system 130. In some examples, coupling the first adaptor component 302 with the wellbore sealing system 130 can involve positioning the first adaptor component 302 such that a surface of the first adaptor component 302 abuts a surface of the wellbore sealing system 130. Positioning the first adaptor component 302 to abut the wellbore sealing system 130 can enable the first adaptor component 302 and the wellbore sealing system 130 to form a load path.

At block 604, a second adaptor component 304 is coupled with the wellbore sealing system 130 for a wellbore 102, and the second adaptor component 304 is coupled to the first adaptor component 302 to cause the magnet 306 and the filler material 308 to interact for exerting a sealing force on the wellbore sealing system 130. The second adaptor component 304 can include a filler material 308 that is magnetically graded. Coupling the second adaptor component 304 can involve positioning the second adaptor component 304 such that the second adaptor component 304 abuts or otherwise physically contacts the first adaptor component 302 and the wellbore sealing system 130.

The sealing force exerted on the wellbore sealing system 130 can be a result of a repulsive force between the first adaptor component 302 and the second adaptor component 304. In some examples, the magnet of the first adaptor component 302 can generate the repulsive force between the first adaptor component 302 and the second adaptor component 304 by interacting magnetically with the filler material. For example, as the magnet approaches a denser portion of the filler material 308, the repulsive force may increase, which may increase the sealing force applied to the wellbore sealing system 130. In some examples, the magnetic interaction can include one or more magnetic dipole-dipole interactions such that magnetic dipoles in the magnet generate the repulsive force with respect to magnetic dipoles that can be present in the filler material. By exerting a force on the wellbore sealing system 130, the magnetically graded adaptor 300 can increase a sealing pressure of the wellbore sealing system 130.

Increasing the sealing pressure of the wellbore sealing system 130 can allow the wellbore sealing system 130 to operate at lower temperatures and higher pressures compared to other wellbore sealing systems. In some examples, the filler material 308 can be dispersed in a gradient according to a concentration profile. The concentration profile can be tailored to a load profile of the sealing system. Dispersing the filler material 308 according to a non-linear concentration profile can enable the magnetically graded adaptor 300 to compensate for an adjusting load.

Figure 7:
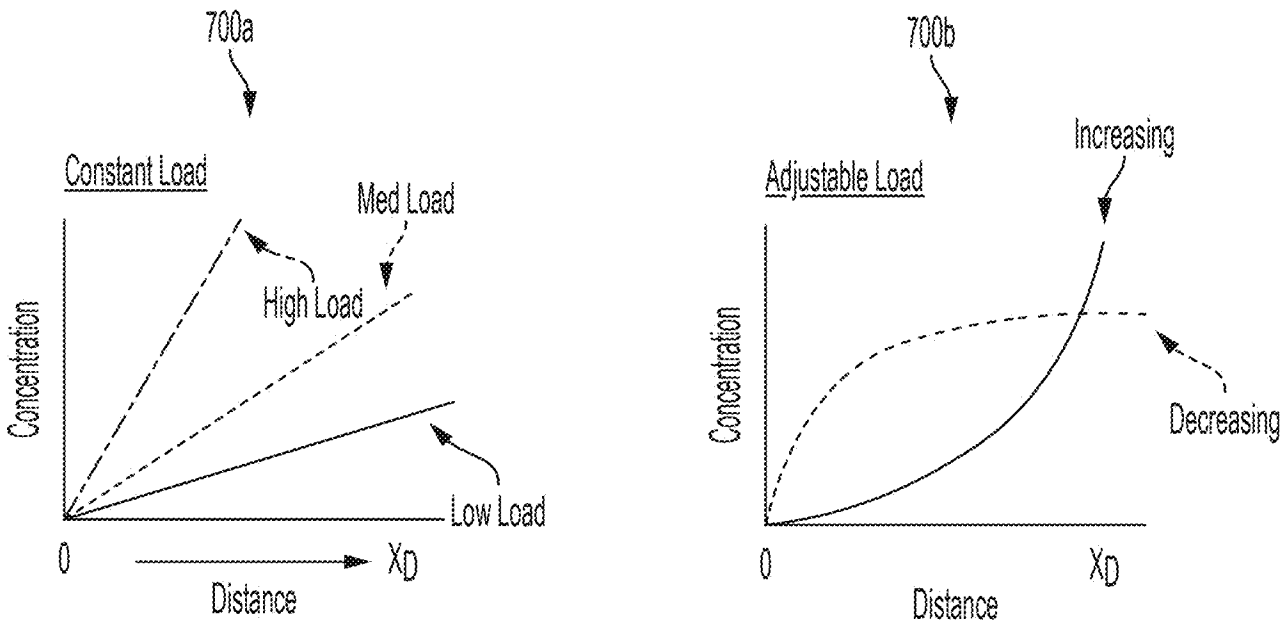
FIG. 7 is a pair of graphs depicting possible load profiles that can be implemented by the magnetically graded adaptor according to one example of the present disclosure.

FIG. 7 is a pair of graphs 700*a-b* depicting possible concentration profiles that can be implemented by the magnetically graded adaptor 300 according to one example of the present disclosure. Each position associated with the magnetically graded adaptor 300 can be represented by a location on the x-axis. A concentration of filler material at each location on the x-axis is displayed on the y-axis. As illustrated, a first graph 700*a* depicts a series of possible concentration profiles that increase linearly as a function of their location with respect to an axis of the magnetically graded adaptor 300. The rate at which the concentration of filler material increases as a function of position on the axis of the magnetically graded adaptor can depend on a load on the wellbore sealing system 130. For example, a magnetically graded adaptor 300 for a wellbore sealing system 130 with a high load can include a steep gradient, whereas a magnetically graded adaptor 300 for a wellbore sealing system 130 with a low load can include a shallow gradient. Linear concentration profiles can be implemented in examples where the load on the sealing system is designed to be constant.

In some examples, the load on the wellbore sealing system 130 can change. For example, fluctuations in ambient temperature or pressure can result in a varying load on the wellbore sealing system 130. To compensate for a variable load, the magnetically graded adaptor 300 can include a non-linear concentration profile, as illustrated in a second graph 700*b*. In other words, the density of the filler material in the magnetically graded adaptor 300 can increase non-linearly in along a given axis of the magnetically graded adaptor 300. In some examples, the load on the wellbore sealing system 130 can increase or decrease with respect to its nominal value. For decreasing loads, the non-linear concentration profile of the filler material can include a positive curvature. For increasing loads the non-linear concentration profile of the filler material can include a negative curvature.

Figure 8:
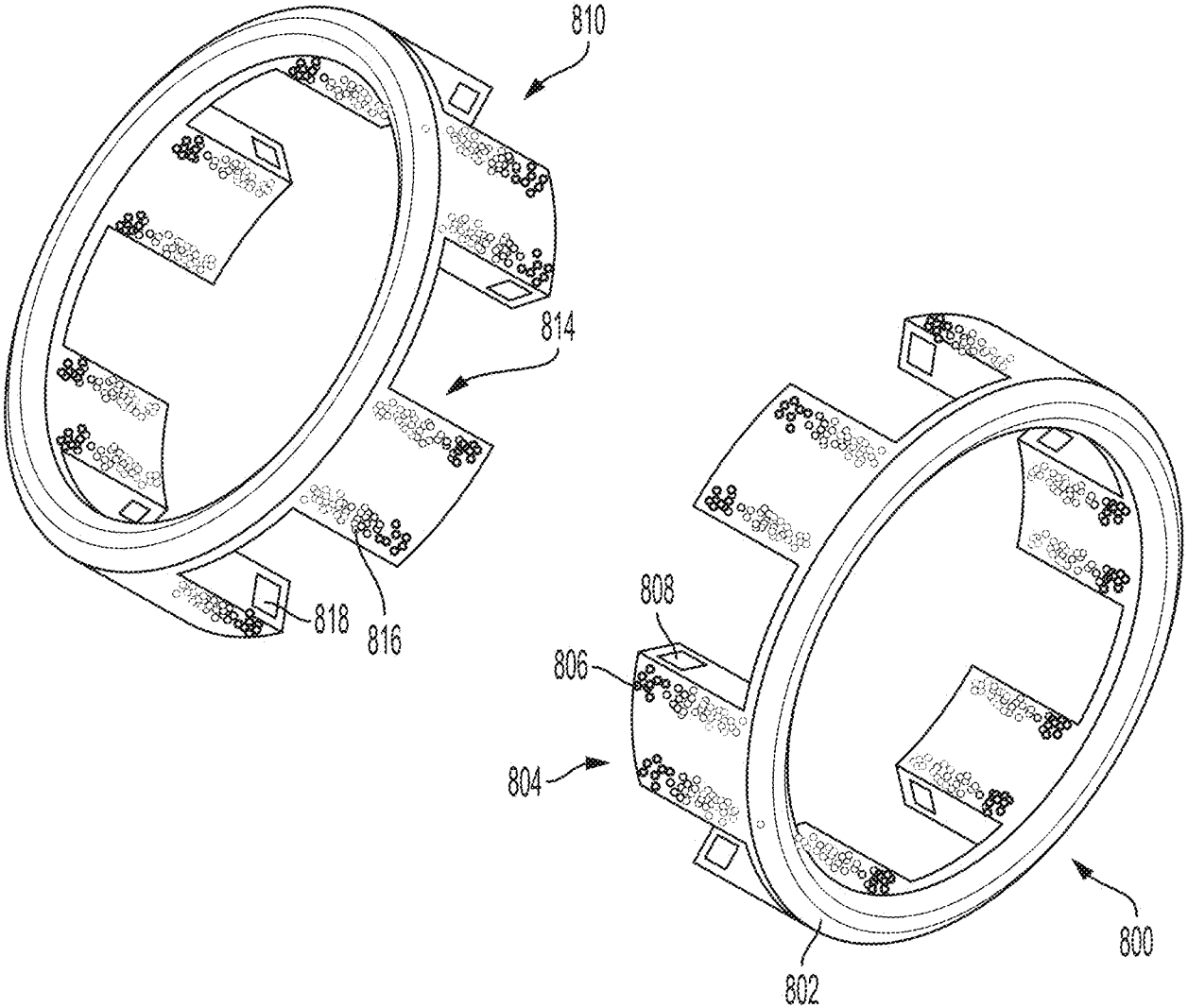
FIG. 8 is a schematic of a magnetically graded adaptor with interlocking teeth for a wellbore sealing system according to one example of the present disclosure.

FIG. 8 is a schematic of a magnetically graded adaptor 800 with interlocking teeth 804 for a wellbore sealing system according to one example of the present disclosure. The interlocking teeth 804 can protrude from a face of a body 802. In some examples, the body 802 can be a ring, though other suitable shapes such as a cylinder, a rectangular prism, or the like are possible. Each interlocking tooth 804, or any subset thereof, can include a magnet 808, a filler material 806 that is magnetically graded, or a combination thereof. The interlocking teeth 804 can be spaced apart to allow opposing interlocking teeth 814 of another magnetically-graded adaptor 810, which may be similar or identical to the magnetically graded adaptor 800, to interlock with the interlocking teeth 804 of the magnetically graded adaptor 800. Once interlocked, the magnet 808 and the filler material 806 of each interlocking tooth 804 can exert a sealing force on an opposing magnet 818 and an opposing filler material 816 on the opposing interlocking teeth 814, respectively. The sealing force can increase a sealing pressure of the wellbore sealing system, for example at low environmental temperatures, high environmental pressures, or a combination thereof.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

In some aspects, adaptors, systems, and methods for a magnetically graded adaptor for a wellbore sealing system are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is an adaptor comprising: a first adaptor component comprising a magnet, the first adaptor component couplable with a wellbore sealing system; and a second adaptor component comprising a filler material that is magnetically graded, the second adaptor component couplable to the wellbore sealing system and positionable with respect to the first adaptor component to cause the magnet and the filler material to magnetically interact for applying a sealing force to the wellbore sealing system.

Example 2 is the adaptor of example 1, wherein the second adaptor component further comprises a polymer binder material that is positionable to encapsulate the filler material, and wherein the filler material is distributable within the polymer binder material according to a concentration profile that corresponds to a magnetic gradient of the filler material.

Example 3 is the adaptor of example 1, wherein the first adaptor component further comprises a second filler material that is magnetically graded and that is positionable to magnetically interact with a second magnet of the second adaptor component, and wherein second adaptor component further comprises the second magnet.

Example 4 is the adaptor of any of examples 1 and 3, wherein: the magnet is a first inner magnet and the second magnet is a second inner magnet; the first adaptor component further comprises a first outer magnet positioned opposite the first inner magnet with respect to the first adaptor component for magnetically interacting with at least the second inner magnet; and the second adaptor component further comprises a second outer magnet positioned opposite the second inner magnet with respect to the second adaptor component for magnetically interacting with at least the first inner magnet.

Example 5 is the adaptor of example 1, wherein the wellbore sealing system comprises an O-ring seal positionable adjacent to the second adaptor component to receive a sealing force from the second adaptor component in response to magnetic interaction between the magnet of the first adaptor component and the filler material of the second adaptor component.

Example 6 is the adaptor of example 1, wherein the filler material is magnetically graded based on a magnetic gradient that is calibrated to compensate for an adjustable load on the wellbore sealing system by adjusting the sealing force based on a distance between the first adaptor component and the second adaptor component.

Example 7 is the adaptor of example 1, wherein the first adaptor component and the second adaptor component are positionable to exert a constant net force on the wellbore sealing system by adjusting the sealing force that is applied to the wellbore sealing system based on a distance between the first adaptor component and the second adaptor component.

Example 8 is a system comprising: a wellbore sealing system positionable in a wellbore; and an adaptor positionable in the wellbore sealing system, the adaptor comprising: a first adaptor component comprising a magnet, the first adaptor component couplable with a wellbore sealing system; and a second adaptor component comprising a filler material that is magnetically graded, the second adaptor component couplable to the wellbore sealing system and positionable with respect to the first adaptor component to cause the magnet and the filler material to magnetically interact for applying a sealing force to the wellbore sealing system.

Example 9 is the system of example 8, wherein the second adaptor component further comprises a polymer binder material that is positionable to encapsulate the filler material, and wherein the filler material is distributable within the polymer binder material according to a concentration profile that corresponds to a magnetic gradient of the filler material.

Example 10 is the system of example 8, wherein the first adaptor component further comprises a second filler material that is magnetically graded and that is positionable to magnetically interact with a second magnet of the second adaptor component, and wherein second adaptor component further comprises the second magnet.

Example 11 is the system of any of examples 8 and 10, wherein: the magnet is a first inner magnet and the second magnet is a second inner magnet; the first adaptor component further comprises a first outer magnet positioned opposite the first inner magnet with respect to the first adaptor component for magnetically interacting with at least the second inner magnet; and the second adaptor component further comprises a second outer magnet positioned opposite the second inner magnet with respect to the second adaptor component for magnetically interacting with at least the first inner magnet.

Example 12 is the system of any of examples 8 and 11, wherein the wellbore sealing system comprises an O-ring seal positionable adjacent to the second adaptor component to receive a sealing force from the second adaptor component in response to magnetic interaction between the magnet of the first adaptor component and the filler material of the second adaptor component.

Example 13 is the system of example 8, wherein the filler material is magnetically graded based on a magnetic gradient that is calibrated to compensate for an adjustable load on the wellbore sealing system by adjusting the sealing force based on a distance between the first adaptor component and the second adaptor component.

Example 14 is the system of example 8, wherein the first adaptor component and the second adaptor component are positionable to exert a constant net force on the wellbore sealing system by adjusting the sealing force that is applied to the wellbore sealing system based on a distance between the first adaptor component and the second adaptor component.

Example 15 is a method comprising: coupling a first adaptor component with a wellbore sealing system, the first adaptor component including a magnet; coupling a second adaptor component with the wellbore sealing system, the second adaptor component including a filler material that is magnetically graded; and applying a sealing force to the wellbore sealing system by causing the magnet and the filler material to magnetically interact.

Example 16 is the method of example 15, further comprising: encapsulating the filler material with a polymer binder material in the second adaptor component; and distributing the filler material within the polymer binder material according to a concentration profile that corresponds to a magnetic gradient of the filler material.

Example 17 is the method of example 15, further comprising positioning a second filler material that is magnetically graded in the first adaptor component to magnetically interact with a second magnet positioned in the second adaptor component.

Example 18 is the method of any of examples 15 and 17, wherein the magnet is a first inner magnet and the second magnet is a second inner magnet, and wherein the method further comprises: positioning a first outer magnet in the first adaptor component opposite the first inner magnet with respect to the first adaptor component for magnetically interacting with at least the second inner magnet; and positioning a second outer magnet in the second adaptor component opposite the second inner magnet with respect to the second adaptor component for magnetically interacting with at least the first inner magnet.

Example 19 is the method of example 15, further comprising positioning an O-ring seal of the wellbore sealing system adjacent to the second adaptor component to receive a sealing force from the second adaptor component in response to magnetic interaction between the magnet of the first adaptor component and the filler material of the second adaptor component.

Example 20 is the method of example 15, wherein the filler material is magnetically graded based on a magnetic gradient that is calibrated to compensate for an adjustable load on the wellbore sealing system by adjusting the sealing force based on a distance between the first adaptor component and the second adaptor component.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An adaptor comprising:

a first adaptor component comprising a magnet, the first adaptor component couplable with a wellbore sealing system; and a second adaptor component comprising a filler material that is magnetically graded, the second adaptor component couplable to the wellbore sealing system and positionable with respect to the first adaptor component to cause the magnet and the filler material to magnetically interact for applying a sealing force to the wellbore sealing system.

2. The adaptor of claim 1, wherein the second adaptor component further comprises a polymer binder material that is positionable to encapsulate the filler material, and wherein the filler material is distributable within the polymer binder material according to a concentration profile that corresponds to a magnetic gradient of the filler material.

3. The adaptor of claim 1, wherein the first adaptor component further comprises a second filler material that is magnetically graded and that is positionable to magnetically interact with a second magnet of the second adaptor component, and wherein second adaptor component further comprises the second magnet.

4. The adaptor of claim 3, wherein:

the magnet is a first inner magnet and the second magnet is a second inner magnet;

the first adaptor component further comprises a first outer magnet positioned opposite the first inner magnet with respect to the first adaptor component for magnetically interacting with at least the second inner magnet; and the second adaptor component further comprises a second outer magnet positioned opposite the second inner magnet with respect to the second adaptor component for magnetically interacting with at least the first inner magnet.

5. The adaptor of claim 1, wherein the wellbore sealing system comprises an O-ring seal positionable adjacent to the second adaptor component to receive a sealing force from the second adaptor component in response to magnetic interaction between the magnet of the first adaptor component and the filler material of the second adaptor component.

6. The adaptor of claim 1, wherein the filler material is magnetically graded based on a magnetic gradient that is calibrated to compensate for an adjustable load on the wellbore sealing system by adjusting the sealing force based on a distance between the first adaptor component and the second adaptor component.

7. The adaptor of claim 1, wherein the first adaptor component and the second adaptor component are positionable to exert a constant net force on the wellbore sealing system by adjusting the sealing force that is applied to the wellbore sealing system based on a distance between the first adaptor component and the second adaptor component.

8. A system comprising:

a wellbore sealing system positionable in a wellbore; and an adaptor positionable in the wellbore sealing system, the adaptor comprising:

a first adaptor component comprising a magnet, the first adaptor component couplable with a wellbore sealing system; and a second adaptor component comprising a filler material that is magnetically graded, the second adaptor component couplable to the wellbore sealing system and positionable with respect to the first adaptor component to cause the magnet and the filler material to magnetically interact for applying a sealing force to the wellbore sealing system.

9. The system of claim 8, wherein the second adaptor component further comprises a polymer binder material that is positionable to encapsulate the filler material, and wherein the filler material is distributable within the polymer binder material according to a concentration profile that corresponds to a magnetic gradient of the filler material.

10. The system of claim 8, wherein the first adaptor component further comprises a second filler material that is magnetically graded and that is positionable to magnetically interact with a second magnet of the second adaptor component, and wherein second adaptor component further comprises the second magnet.

11. The system of claim 10, wherein:

the magnet is a first inner magnet and the second magnet is a second inner magnet;

the first adaptor component further comprises a first outer magnet positioned opposite the first inner magnet with respect to the first adaptor component for magnetically interacting with at least the second inner magnet; and the second adaptor component further comprises a second outer magnet positioned opposite the second inner magnet with respect to the second adaptor component for magnetically interacting with at least the first inner magnet.

12. The system of claim 11, wherein the wellbore sealing system comprises an O-ring seal positionable adjacent to the second adaptor component to receive a sealing force from the second adaptor component in response to magnetic interaction between the magnet of the first adaptor component and the filler material of the second adaptor component.

13. The system of claim 8, wherein the filler material is magnetically graded based on a magnetic gradient that is calibrated to compensate for an adjustable load on the wellbore sealing system by adjusting the sealing force based on a distance between the first adaptor component and the second adaptor component.

14. The system of claim 8, wherein the first adaptor component and the second adaptor component are positionable to exert a constant net force on the wellbore sealing system by adjusting the sealing force that is applied to the wellbore sealing system based on a distance between the first adaptor component and the second adaptor component.

* * * * *